US006661002B2

(12) United States Patent
Satta et al.

(10) Patent No.: US 6,661,002 B2
(45) Date of Patent: Dec. 9, 2003

(54) MASS SPECTROGRAPH

(75) Inventors: Hideo Satta, Kanagawa (JP); Hiroaki Waki, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 76 days.

(21) Appl. No.: 10/002,353

(22) Filed: Nov. 14, 2001

(65) Prior Publication Data

US 2002/0038850 A1 Apr. 4, 2002

Related U.S. Application Data

(63) Continuation-in-part of application No. 09/615,380, filed on Jul. 13, 2000.

(30) Foreign Application Priority Data

Aug. 20, 1999 (JP) ..... 11-234615

(51) Int. Cl.[7] ..... H01J 49/00
(52) U.S. Cl. ..... 250/288; 250/292
(58) Field of Search ..... 250/288, 281, 250/282, 292, 290

(56) References Cited

U.S. PATENT DOCUMENTS 4,358,302 A * 11/1982 Dahneke ..... 250/288
4,863,491 A * 9/1989 Brandt et al. ..... 250/288
5,432,343 A * 7/1995 Gulcicek et al. ..... 250/288
5,447,553 A * 9/1995 Apffel, Jr. et al. ..... 250/288
5,793,039 A * 8/1998 Oishi et al. ..... 250/288
5,847,386 A * 12/1998 Thomson et al. ..... 250/288

* cited by examiner

*Primary Examiner*—Kiet T. Nguyen
(74) *Attorney, Agent, or Firm*—Beyer Weaver & Thomas LLP

(57) ABSTRACT

A mass spectrograph has an ionization chamber for ionizing a sample, a skimmer in a conical shape with an orifice and a bottom opening, an analyzing chamber at a lower pressure than inside the ionization chamber such that ions generated in the ionization chamber are pulled through the orifice into the analyzing chamber, and a multi-pole ion guide disposed proximally behind the skimmer. The ion guide has an even number of cylindrically shaped electrodes all elongated in the axial direction of the skimmer and the ion guide and disposed so as to circumscribe an inscribed circle and such that the conical surface of the skimmer, when extended, intersects the internally facing side surfaces of the electrodes, not their front surfaces facing the skimmer. Thus, the generated ions can reach the analyzing chamber more efficiently.

4 Claims, 3 Drawing Sheets

MASS SPECTROGRAPH

This is a continuation-in-part of application Ser. No. 09/615,380 filed Jul. 13, 2000, now pending.

BACKGROUND OF THE INVENTION

This invention relates to a mass spectrograph of the type for ionizing a sample under a relatively near atmospheric condition of pressure such as an inductively coupled plasma mass spectrograph (ICP-MS), an electro spray mass spectrograph (ES-IMS) or an atmospheric pressure chemical ionization mass spectrograph (APCI-MS).

A prior art ESI-MS is shown schematically in FIG. 4 and an portion thereof around its skimmer is shown enlarged in FIG. 5. This mass spectrograph is provided with a first intermediate chamber 12 and a second intermediate chamber 15 between an ionization chamber 10 having a nozzle 11 connected to the outlet of the column of a liquid chromatographic apparatus and an analyzing chamber 18 with a quadrupole filter 19 and an ion detector 20, each being mutually separated by a partition wall. The ionization chamber 10 and the first intermediate chamber 12 are connected only through a heated capillary of a small inner diameter serving as a solvent-removing pipe 13. The first intermediate chamber 12 and the second intermediate chamber 15 are connected only through a conically shaped skimmer 16 having an orifice 16*a* of a small diameter at its tip.

The interior of the ionization chamber 10 is nearly in the atmospheric condition due to the gasified molecules of the sample liquid continuously supplied thereinto through the nozzle 11. The interior of the first intermediate chamber 12 is at a low vacuum condition of about $10^2$ Pa by means of a rotary pump (RP). The interior of the second intermediate chamber 15 is at a medium vacuum condition of about $10^{-1}$–$10^{-2}$ Pa by means of a turbo-molecular pump (TMP). The interior of the analyzing chamber 18 is at a high vacuum condition of about $10^{-3}$–$10^{-4}$ Pa by means of another turbo-molecular pump (TMP). In other words, the degree of vacuum increases as one moves from one chamber to the next, starting at the ionization chamber 10 towards the analyzing chamber 18 such that the interior of the analyzing chamber 18 is maintained at a high vacuum condition.

A sample liquid is sprayed (or electro-sprayed) through the nozzle 11 into the ionization chamber 10, and the sample molecules are ionized while the solvent contained in the liquid drops is evaporated. Small liquid droplets with ions mixed in are pulled into the solvent-removing pipe 13 due to the pressure difference between the ionization chamber 10 and the first intermediate chamber 12. As they pass through the solvent-removing pipe 13, the solvent is evaporated and the process of ionization proceeds further. A pair of mutually facing planar electrodes or a ring-shaped electrode 14 is provided inside the first intermediate chamber 12. The electric field generated by this electrode 14 serves not only to pull in the ions through the solvent-removing pipe 13 but also to converge the ions to a point ("backward focal point") F near the orifice 16*a* of the skimmer 16.

The converged ions are caused to pass through the orifice 16*a* of the skimmer 16 by the pressure difference between the first intermediate chamber 12 and the second intermediate chamber 15 and is directed into the analyzing chamber 18 after being converged and accelerated by means of an ion guide 17 (also referred to as the ion lens or the ion-transporting lens). Inside the analyzing chamber 18, only those of the ions having a specified mass number (the ratio of mass m to charge z) are passed through the longitudinal space at the center of the quadrupole filter 19 and reach the ion detector 20 to be detected thereby.

The function of the ion guide 17 is to accelerate flying ions while causing them to be converged. Ion guides with many different shapes have been proposed. The so-called multi-pole type is one of known types, having a plurality of approximately cylindrically shaped rod electrodes arranged so as to circumscribe a circle of diameter d1 and mutually separated and having a voltage difference superposing high-frequency voltages with phases mutually inverted by a same direct-current voltage applied between each mutually adjacent pair of these rod electrodes. Such a high-frequency electric field causes the ions introduced in the direction of the optical axis C to move forward while vibrating at a specified frequency. As a result, the ions can be converged more effectively and more ions can be sent into the analyzing chamber 18 on the downstream side.

For the purpose of passing ions as efficiently as possible through the first intermediate chamber 12 and the second intermediate chamber 15, it is desirable to reduce the distance as much as possible between the orifice 16*a* and the space surrounded by the rod electrodes of the ion guide 17. For this reason, the end surface of the ion guide 17 facing the skimmer 16 is formed with a slope so as to match the sloped surface of the skimmer 16 and the ion guide 17 is disposed such that its sloped end surface protrudes into the conically shaped portion of the skimmer 16. This makes it time-consuming to fabricate the rod electrodes, affecting the production cost adversely.

Another problem is that the orifice 16*a* of the skimmer 16 and its neighboring parts become contaminated with sample ions that stick to them, and the skimmer 16 must therefore be designed to be detachable. With the skimmer 16 and the ion guide 17 as formed above, either of them should be made slidable in the direction of the aforementioned optical axis C or the skimmer 16 must be attached to be rotatable by means of a hinge. This causes the attachment mechanism of the skimmer 16 and the ion guide 17 to be complicated.

SUMMARY OF THE INVENTION

It is therefore an object of this invention in view of the problems described above to provide a mass spectrograph having an ion guide with a simplified structure and a simplified attachment mechanism for the skimmer while maintaining a high level of efficiency in passing ions.

A mass spectrograph embodying this invention, with which the above and other objects can be accomplished, may be characterized not only as being of the kind having an ionization chamber for ionizing a sample, a skimmer in a conical shape with an orifice, an analyzing chamber at a lower pressure than inside the ionization chamber such that the generated ions are pulled through the orifice into the analyzing chamber, and a multi-pole ion guide which is disposed immediately behind the skimmer and comprised of an even number of cylindrically shaped electrodes all elongated in an axial direction but also wherein these electrodes are disposed so as to circumscribe an inscribed circle and the bottom surface of the conically shaped skimmer has a smaller diameter than the inscribed circle of the ion guide such that the ions can reach the analyzing chamber more efficiently.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 2:
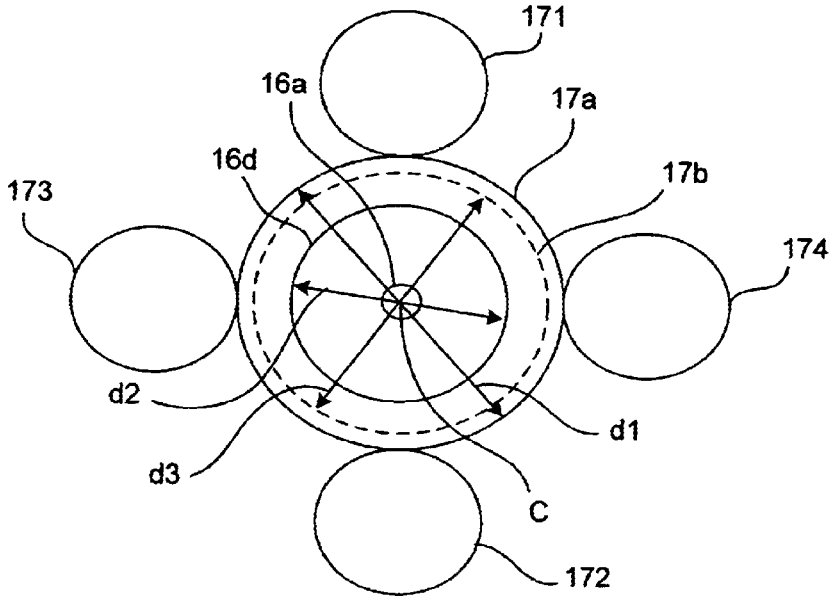
FIG. 2 is a schematic longitudinal view of the skimmer and the ion guide of the mass spectrograph of FIG. 1 for showing their positional relationship.
Figure 3:
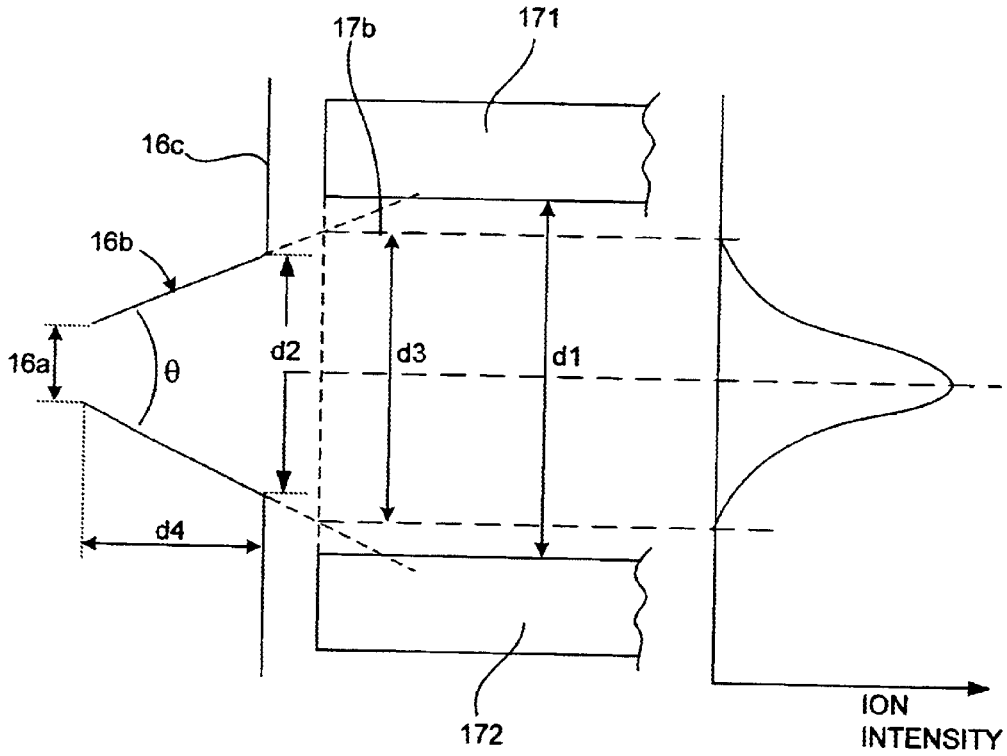
FIG. 3 is a graph showing the relationship between the density distribution of ions which have passed through the skimmer and the positional relationship of the skimmer with respect to the ion guide of the mass spectrograph of FIG. 1.
Figure 4:
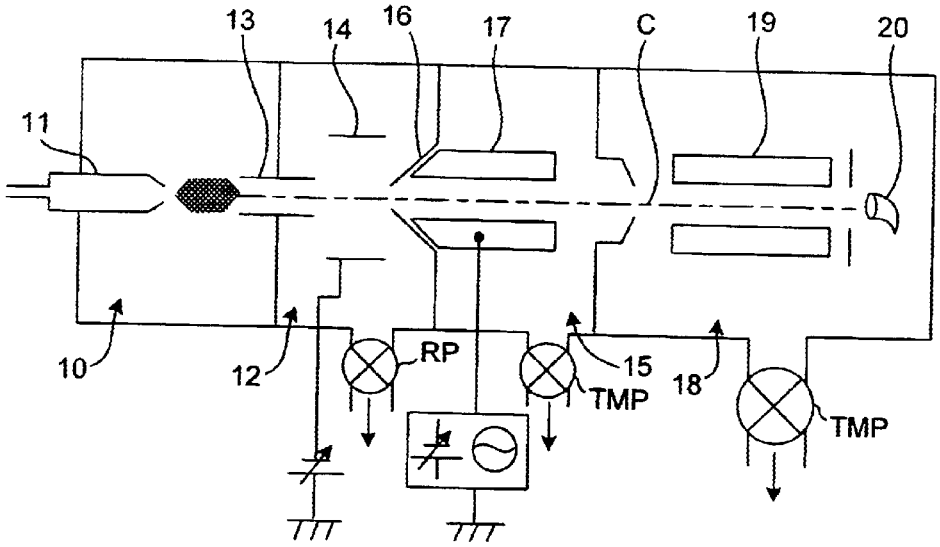
FIG. 4 (PRIOR ART)
FIG. 4 is a schematic structural diagram of an example of conventional electro spray mass spectrograph (ESI-MS)
Figure 5:
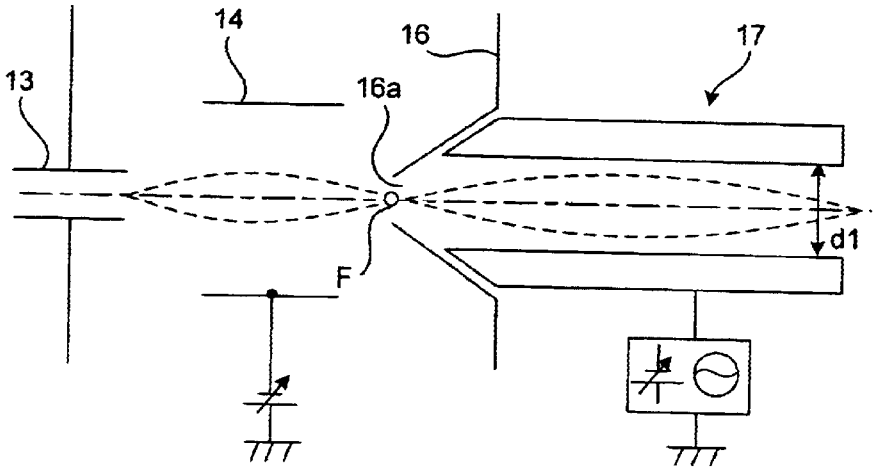
FIG. 5 (PRIOR ART)
FIG. 5 is a view of a portion of FIG. 4 around the skimmer shown enlarged.

The invention is described next by way of an example with reference to FIGS. 1–3. Since the general structure of this exemplary mass spectrograph to be described is as shown in FIG. 4 except the design and positional and dimensional relationship of its ion guide with respect to the skimmer, only the aspects which are different from what has been described above with reference to FIGS. 4 and 5 will be described for the convenience of disclosure.

Figure 1:
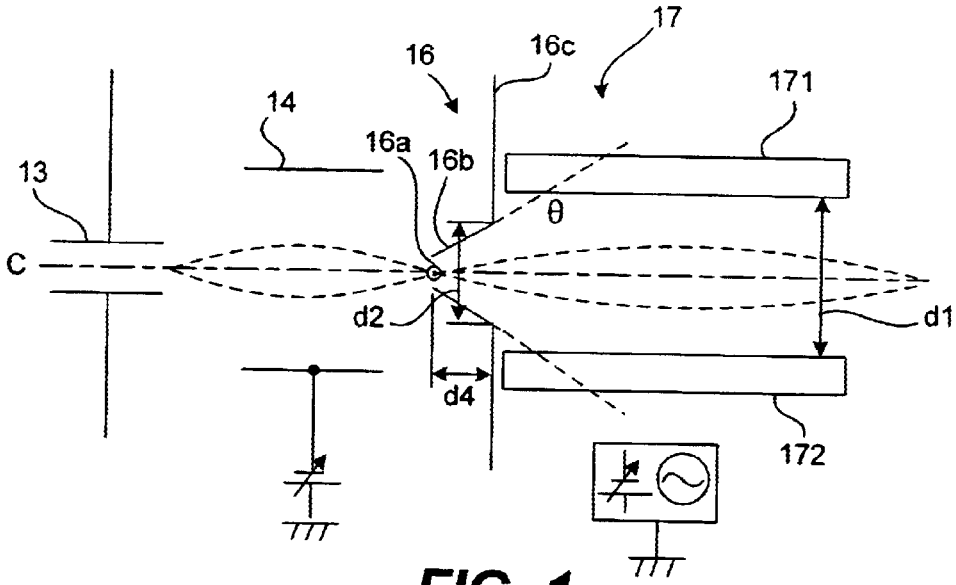
FIG. 1 is a drawing for showing the structure around the skimmer of a mass spectrograph embodying this invention.

As shown in FIG. 1, the mass spectrograph according to this example is characterized as having rod electrodes 171 and 172 (and also 173 and 174 shown in FIG. 2) of its ion guide 17 which are nearly perfectly cylindrical in shape with their end surfaces opposite the skimmer 16 cut perpendicularly to the axial direction. The diameter d1 of the inscribed circle 17*a* of this ion guide 17 is uniquely determined by the diameter of rod electrodes and other factors. On the other hand, the opening angle θ at the top of the skimmer 16 is determined by taking into account the efficiency with which ions can pass through, and it is usually 40–60°. The diameter d2 of the bottom opening 16*d* of the conically shaped part 16*b* of the skimmer 16 is selected to be sufficiently smaller than d1 in view of how close the rod electrodes 171–174 are disposed to the skimmer 16. Explained more in detail, the conical surface of the skimmer 16 (that is, the surface defining the conically shaped part 16*b* of the skimmer 16), when extended towards the downstream side towards the ion guide 17, intersects the internally facing side surfaces of the rod electrodes 171–174, rather than their front surface facing the skimmer 16, as shown by broken lines in FIG. 1 and more clearly in FIG. 3. The height d4 of the conical part 16*b* is determined automatically from the opening angle θ and the diameter d2 of the bottom opening 16*d*. From FIG. 3, it is clear that d1 is necessarily larger than d2, according to this invention.

If the dimensional relationship between the skimmer 16 and the ion guide 17 is thus determined, the ions which pass through the orifice 16*a* of the skimmer 16 and advance forward in a diverging way nearly entirely enter the space inside the inscribed circle 17*a* of the ion guide 17. The ions which enter this space are appropriately converged by the electric field formed by the voltages applied to the rod electrodes 171–174 and thereafter sent into the analyzing chamber on the downstream side. The efficiency of the ions passing through the ion guide 17 is thus improved.

In reality, however, those of ions which are introduced inside the inscribed circle 17*a* but closer to its outer periphery have a low probability of being properly made to converge and their efficiency is not necessarily high for passing through the ion guide 17. In FIG. 2, the dotted circle with diameter d3 around the optical axis C indicates the so-called acceptance area 17*b* where the passing efficiency for ions is extremely high. FIG. 3 shows the ion density distribution in the radial direction with respect to the position of the skimmer 16 as well as that of the ion guide 17. As can be seen, the ion density is the largest near the ion optical axis C, quickly becoming smaller as the outer periphery is approached but there are some ions, although few, even near the peripheral wall of the skimmer 16. With the structure as shown in FIG. 1, the ions emitted from areas close to the peripheral wall of the conically shaped part 16*b* of the skimmer 16 reach the space outside the acceptance area 17*b*, having an extremely small probability of passing through the ion guide 17. For improving the efficiency for passing the ions through, therefore, it is preferable to make the diameter d2 of the bottom surface of the conically shaped part 16*b* of the skimmer 16 smaller than the diameter d3 of the acceptance area 17*b*. If the size relationship is so chosen, almost all of the ions which pass through the orifice 16*a* of the skimmer 16 enter the acceptance area 17*b*, are appropriately converged by the ion guide 17 and reach the analyzing chamber 18 with a high probability.

If the height d4 of the conically shaped part 16*b* of the skimmer 16 is too low, however, gasified solvent traveling slightly off the ion optical axis cannot be eliminated satisfactorily even where the opening angle θ at the top satisfies the condition given above. In reality, it is difficult to make the diameter d2 of the bottom surface of the conically shaped part 16*b* of the skimmer 16 much smaller than the diameter d3 of the acceptance area 17*b*. It is appropriate to make the diameters d2 and d3 nearly equal to each other.

Although the invention was described above by way of only one example, this example is intended to be considered illustrative, not as limiting. It goes without saying that many modifications and variations are possible within the scope of this invention. With a mass spectrograph embodying this invention, ions pass through the orifice of the skimmer towards the analyzing chamber due to the pressure difference and even those of the ions entering divergently along the inner peripheral wall of the conically shaped part of the skimmer can be dependably directed into the space surrounded by the ion guide. As a result, more ions can be converged by the ion guide and directed into the mass spectrometer and hence the sensitivity and accuracy of analysis can be improved.

With a mass spectrograph embodying this invention, furthermore, the end part of the ion guide does not penetrate the conically shaped part of the skimmer and hence the skimmer can be moved sideways (perpendicularly to the axial direction) without first retracting the ion guide. Thus, the mechanism for detaching and attaching the skimmer can be simplified. Since the rod electrodes of the ion guides can be produced simply by cutting the rods perpendicularly to form the end surfaces, the manufacturing process is simpler and the production cost can be reduced.

What is claimed is:

1. A mass spectrograph comprising:

an ionization chamber for generating ions by ionizing a sample therein;

a conically shaped skimmer having a bottom opening and a top orifice defining a conical surface around an axis;

an analyzing chamber at a lower pressure than inside said ionization chamber such that the generated ions are pulled through said orifice into said analyzing chamber; and a multi-pole ion guide disposed immediately behind said skimmer, said ion guide comprising an even number of cylindrically shaped electrodes which are all elongated along said axis, having internally facing side surfaces facing one another, and are disposed so as to circumscribe an inscribed circle and sufficiently close to said skimmer such that said conical surface, when extended, intersects said internally facing side surfaces of said electrodes.

2. The mass spectrograph of claim 1 wherein said electrodes are disposed mutually separated.

3. The mass spectrograph of claim 1 wherein each of said electrodes has a end surface which is perpendicular to said axial direction and disposed opposite and facing said skimmer.

4. The mass spectrograph of claim 1 wherein said conically shaped skimmer has a top angle of 40–60°.

* * * * *